US006371642B1

(12) United States Patent
Nelson et al.

(10) Patent No.: US 6,371,642 B1
(45) Date of Patent: Apr. 16, 2002

(54) SMALL ITEMS BAG FOR USE IN DISHWASHER

(75) Inventors: David William Nelson, Chicago; Stephen Dylan Berry, Plainfield; Scott Harold Wilson, Evanston, all of IL (US); Thomas H. Buckleitner, Findlay, OH (US); Paul Richard Staun, Granger, IN (US); Pamela Sue Rogers, St. Joseph; David J. Hoyh, Stevensville, both of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/757,945

(22) Filed: Jan. 10, 2001

(51) Int. Cl.[7] ..... B65D 33/14

(52) U.S. Cl. ..... 383/23; 150/900; 383/34; 383/43; 383/117

(58) Field of Search ..... 383/117, 34, 43, 383/23; 150/900, 120

(56) References Cited

U.S. PATENT DOCUMENTS

| | | | | | |
|---|---|---|---|---|---|
| 1,853,013 | A | * | 4/1932 | Brady | 383/117 |
| 2,008,314 | A | * | 7/1935 | Russell | 150/900 |
| 2,142,764 | A | * | 1/1939 | Kluger | 150/900 |
| 2,142,904 | A | * | 1/1939 | Lamarthe | 150/900 |
| 2,158,955 | A | * | 5/1939 | Blacher | 150/900 |
| 3,310,224 | A | * | 3/1967 | Laguerre | 383/43 |
| 3,960,290 | A | | 6/1976 | Yake et al. | 220/338 |
| 4,058,233 | A | | 11/1977 | Frangos | 220/19 |
| 4,732,291 | A | | 3/1988 | McConnell | 220/19 |
| 4,801,081 | A | * | 1/1989 | O'Connor | 383/24 |
| 4,834,125 | A | | 5/1989 | Insalaco | 134/201 |
| 5,092,682 | A | * | 3/1992 | Fenick | 383/117 |
| 5,102,225 | A | | 4/1992 | Hollinger et al. | 383/23 |
| 5,118,019 | A | * | 6/1992 | Harrison | 383/117 |
| 5,211,191 | A | | 5/1993 | Brown | 134/201 |
| 5,253,775 | A | * | 10/1993 | Gould | 383/117 |
| 5,401,101 | A | * | 3/1995 | Wang | 383/117 |
| 5,405,018 | A | | 4/1995 | Anthrop, Jr. | 211/13 |
| 5,497,890 | A | | 3/1996 | Clark | 211/41 |
| 5,518,126 | A | | 5/1996 | Davis | 211/41 |
| 5,524,990 | A | | 6/1996 | Buck | 383/34 |
| 5,857,473 | A | | 1/1999 | Vanover et al. | 134/135 |
| 6,174,848 | B1 | * | 1/2001 | Dawson et al. | 383/117 |

* cited by examiner

*Primary Examiner*—Stephen P. Garbe
(74) *Attorney, Agent, or Firm*—Joel M. Van Winkle; Robert O. Rice; Stephen D. Krefman

(57) ABSTRACT

A mesh bag for holding small items in a dishwasher. The bag preferably includes a top frame having a resilient front rail member and a resilient rear rail member. Each rail member has opposite ends. The rail members are pivotably joined at their ends such that the rail members are disposed adjacent each other. A mesh body depends from the top frame and has a substantially flat, rectangular shape. The mesh body includes a first mesh side wall and a second mesh side wall joined together along opposite side edges and a bottom edge. The top edge of the first mesh side wall is connected to the front rail member and the top edge of the second mesh side wall is connected to the rear rail such that the frame forms a closure mechanism for the bag.

8 Claims, 2 Drawing Sheets

SMALL ITEMS BAG FOR USE IN DISHWASHER

BACKGROUND OF THE INVENTION

1. Field of the Invention

The present invention relates generally to a mesh bag for holding various small objects or articles in fixed positions in an automatic dishwasher.

2. Description of the Related Art

Conventional household dishwashers usually comprise upper and lower racks for containment of silverware, plates, bowls, glasses and other items that are to be washed. A water spray device is associated with each rack for spraying heated water on the items in the rack. Typically each water spray device will comprise a horizontal arm mounted below the rack for rotary motion around a central vertical axis. Ports are formed along the upper face of the arm for discharging jets of water upwardly out of the arm and onto the undersides of the items in the rack (located above the water spray arm). The arm is constructed so that water supply pressure causes the arm to rotate around a central point along the length of the arm. The water spray arm thus rotates as its sprays the items in the rack, such that all of the items are subjected to the water spray action.

Small lightweight items in the rack are sometimes dislodged from the rack, due to the force of the water sprays. In some cases these small items can become airborne and subsequently fall through openings in the rack so as to eventually be deposited on the bottom wall of the dishwasher.

Most dishwashers include an electrical heating element on the dishwasher bottom wall for heating the space within the dishwasher, to thus promote drying of the washed items. In the event that an item inadvertently contacts the heating element it may melt or otherwise be destroyed, due to the relatively high temperature on the heating element surface.

Various solutions have been proposed for supporting small items within an automatic dishwasher. U.S. Pat. No. 3,960,290 discloses a rigid plastic utility basket for use in the upper or lower rack of a dishwasher. The utility basket is provided with a hinged lid which may be arranged in a closed position for covering and securing small wares or items.

U.S. Pat. No. 5,102,225 discloses a mesh bag for securing small items within a dishwasher. The mesh bag is preferably an elongated tubular envelope having a short, longitudinal open end for insertion or removal of items. The bag may be secured to one of the racks in a dishwasher.

U.S. Pat. No. 5,211,191 also discloses a dishwasher bag for securing small items in an automatic dishwasher. The bag is provided with a large opening at the top which is formed by a rigid frame member. A cover member is associated with the rigid frame for securing items within the bag.

All of these prior art solutions have various drawbacks. The rigid basket disclosed in the '290 patent occupies a large amount of space and is relatively expensive. This is also true for the dishwasher bag of the '191 patent. The mesh bag disclosed in the '225 patent is configured in a manner that makes it relatively difficult to insert small items thereinto.

SUMMARY OF THE INVENTION

The present invention relates to an add-on bag structure installable in a dishwasher for containment of small lightweight items that might have a tendency to become airborne due to the force of the water sprays associated with normal dishwasher operation. Items that could be held in the bag include rubber baby bottle nipples; baby bottle caps; plastic spoons, forks and knives; small measuring spoons and cups; and small drinking glasses, light weight lids, etc.

The present invention is therefore directed to a bag for holding small items in a dishwasher. The bag preferably includes a top frame having a resilient front rail member and a resilient rear rail member. Each rail member has opposite ends. The rail members are pivotably joined at their ends such that the rail members are disposed adjacent each other. A mesh body depends from the top frame and has a substantially flat, rectangular shape. The mesh body includes a first mesh side wall and a second mesh side wall joined together along opposite side edges and a bottom edge. The top edge of the first mesh side wall is connected to the front rail member and the top edge of the second mesh side wall is connected to the rear rail such that the frame forms a closure mechanism for the bag which is biased in a closed orientation.

The bag is designed to completely envelope the items so that the force of the water sprays cannot dislodge the items; the items remain in the bag during the machine cycle (washing, rinsing, and drying). One of the rail members is connectable to one of the racks in the dishwasher such that the frame can be readily pulled open using one hand.

DESCRIPTION OF A PREFERRED EMBODIMENT OF THE INVENTION

Figure 1:
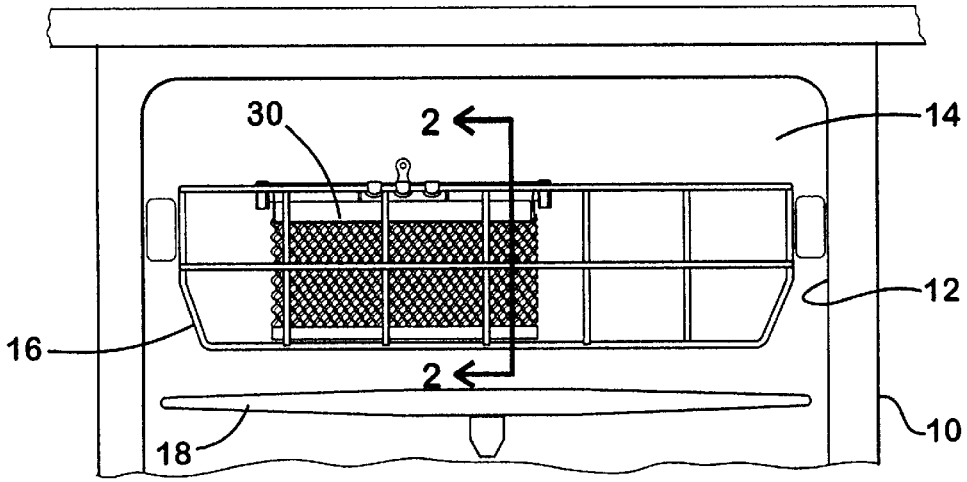
FIG. 1 is a fragmentary front view of a conventional dishwasher showing a rack structure therein. A bag of the present invention is shown suspended from the rack structure.

As shown in FIG. 1, the present invention is intended for use in a conventional dishwasher 10 having a door opening 12 for access to an otherwise closed space 14 that houses two dishracks including an upper dishrack 16. The space immediately below the dishrack 16 contains a hollow water spray arm 18 that is fluidly connected to a water supply. The arm 18 is supported for rotation such that while water is being delivered to the spray arm the arm rotates around a central vertical axis (i.e. a vertical axis located at the geometrical center of space 14). Spray arm 18 has a series of water ports spaced along its upper face for delivering jets of water upwardly against items supported in the rack 16. Preferably, the spray arm 18 has a length that is almost the side-to-side dimension of enclosed space 14. The rotary spray arm thereby has essentially complete spray coverage of the rack contents.

Figure 2:
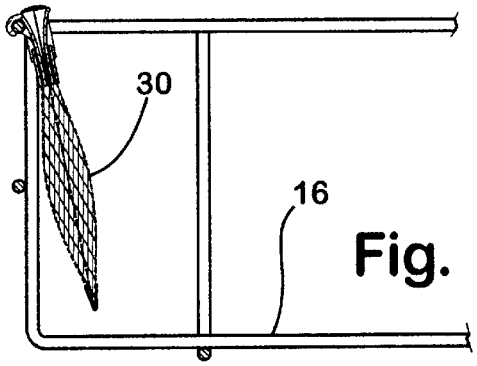
FIG. 2 is a fragmentary sectional view taken on line 2—2 in FIG. 1.

The present invention relates to an add-on small items bag 30 formed of a plastic open mesh material. FIGS. 1 and 2 show a preferred embodiment of the small items bag 30 suspended within rack 16. The small items bag 30 is configured to attach to the rack 16 through snap connection or clip means.

Figure 3:
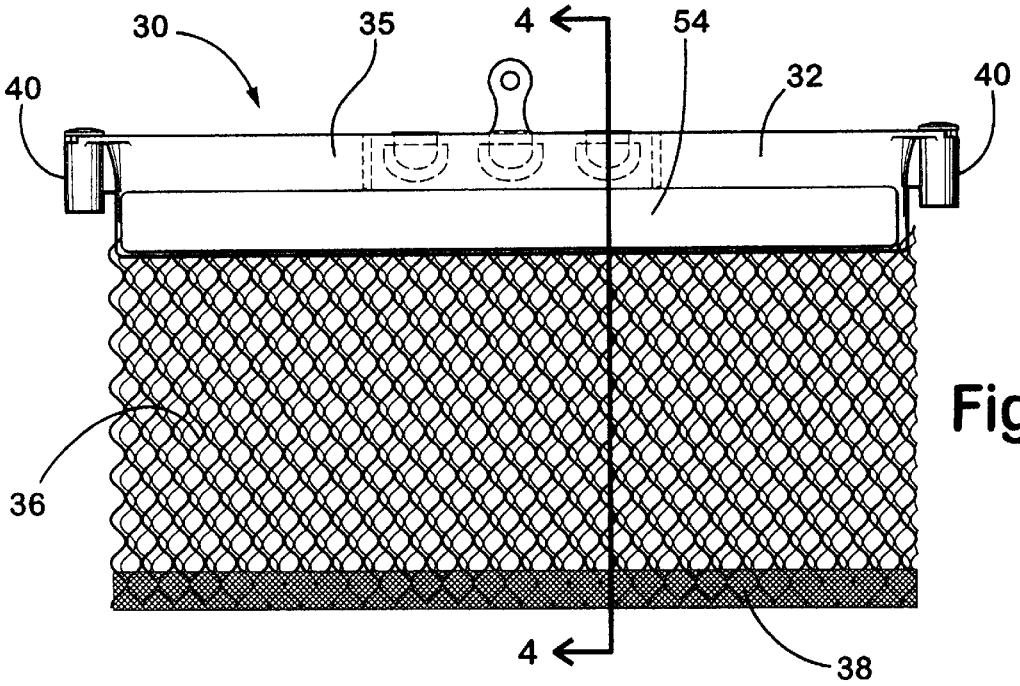
FIG. 3 is an enlarged front elevational view of the bag shown in FIG. 1.
Figure 4:
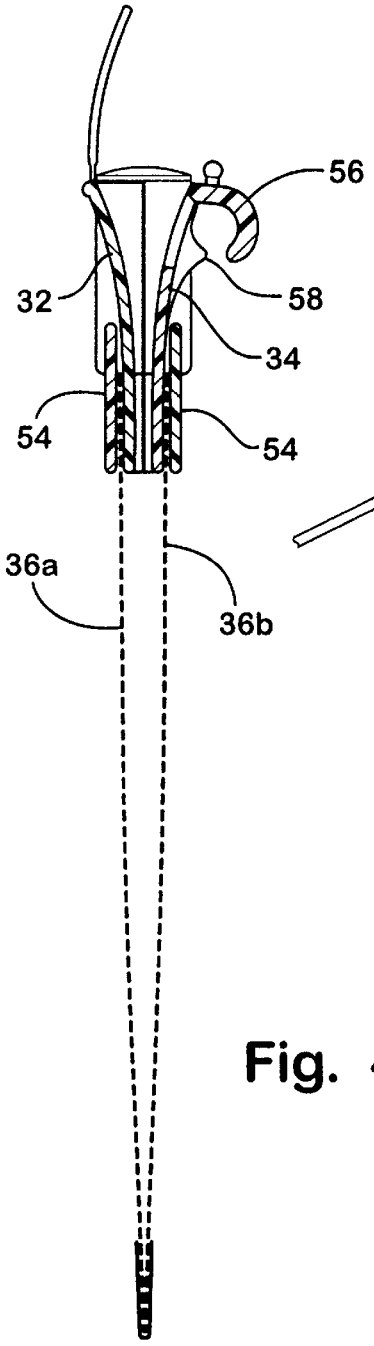
FIG. 4 is a sectional view taken on line 4—4 in FIG. 3.
Figure 5:
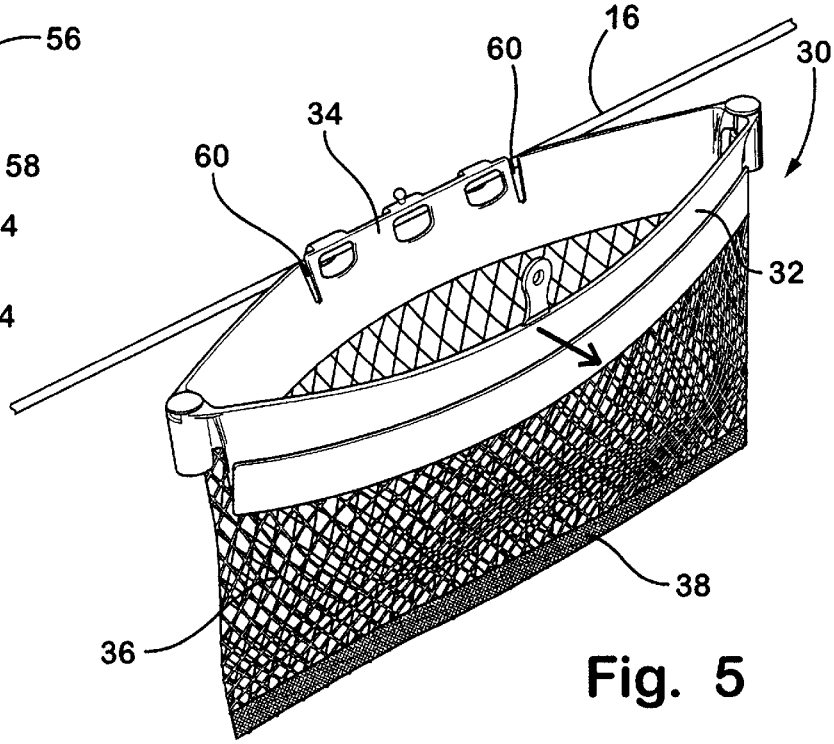
FIG. 5 is a perspective view of the bag attached to a rack structure wherein the top frame is flexed into an open orientation.

It can be seen in FIGS. 3–5 that the bag 30 includes a pair of elongated members or front and rear rails 32 and 34 which form a top frame 35 along the top edge of the bag, a mesh body 36 and a bottom edge 38. The front and rear rail 32 and 34 are elongated members preferably formed from plastic material. In the disclosed embodiment, the rear rail member 34 is secured to the rack through snap connection means.

Figure 6:
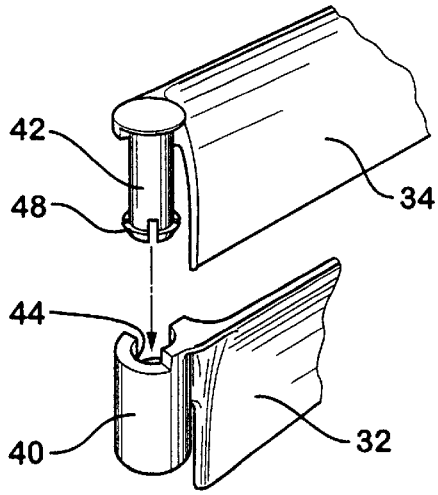
FIG. 6 is an enlarged, perspective view of the ends of the front rail member and the rear rail member showing the pivotable connection between these elements.

In the preferred embodiment, the rail members 32 and 34 are connected at their ends through a hole and pin arrangement. The front rail member 32 is provided at opposite ends with cylindrical structures 40, as best shown in FIG. 6. The rear rail member 34 is provided at opposite ends with a hinge pin 42. The rail members 32 and 34 are connected together by inserting the hinge pins 42 into the bores 44 formed by the cylindrical structures 40. Each hinge pin 42 is provided with flexible retention prong elements 48 which resiliently deflect when the pins 42 are inserted into the bores 44 and secure the pin 42 within the bores 44.

The mesh body 36 of the small items bag 30 may be formed by a single piece of open mesh material having a tubular configuration. The tube is pressed substantially flat thereby forming creases on opposite side edges and forming opposite side walls 36*a* and 36*b*. The top edge of the side wall 36*a* is secured to the front rail 32 while the top edge of the side wall 36*b* is secured to the rear rail 34. While this can be done in any number of ways, in the preferred embodiment the mesh body 36 is secured to the rails 32 and 34 through heat welding. In particular, a pair of retention strips 54 are heat welded to the rails and sandwich the mesh side walls 36*a* and 36*b* therebetween thereby securing the mesh body to the rails.

The bottom edge 38 of the mesh body 36 is secured together to form a bottom edge of the bag 30. The bottom edge 38 maybe secured together using any number of know joining techniques such as welding or adhesives or through the addition of some joining strips. In the preferred embodiment, the bottom edge 38 is secured together using a tape such as fine mesh tape.

As mentioned above, the small items bag is preferably installed onto rack 16 so that it is firmly attached to the rack but is nevertheless removable from the rack 16. In particular, the rear rail 34 is formed having a plurality of resilient hook members 56. The hook members 56 cooperate with retention ribs 58 to connect to a wire of the rack 16.

It can be understood by one skilled in the art, therefore, that the top frame 35 forms a closure mechanism for the small items bag that is resiliently biased to a closed position but which can be readily opened. The small items bag 30 may be opened by pulling the front rail member 32 away from the rear rail member 34. Only a single hand is necessary to separate the front and rear rail members 32 and 34 as the rear rail member 34 is secured to the rack 16. This is best shown in FIG. 5. When opening the small items bag 30, the rail members flex into a bowed state. Notches 60 may be provided in the rail members to promote rail flexing at particular locations. Additionally, the terminal ends of the rails 32 and 34 pivot with respect to each other to facilitate the separation of the front and rear rail members 32 and 34. In this manner, the small items bag 30 can readily be opened to allow easy placement of small items into and removal from the small items bag 30.

The present invention is particularly advantageous over the prior art because of the relatively large opening that can be created between the rail members when the front rail 32 is separated from the rear rail 34. In this manner, the items can be easily placed into the small items bag 30 with the bag 30 connected to the rack. The bag 30 can expand to accommodate a relatively large amount of items. However, when not in use, the bag 30 takes up relatively little space due to its substantially flat profile.

The drawings necessarily show a specific embodiment of the invention. However, it will be appreciated that some changes could be made while still practicing this invention. For example the bag can be formed of different materials. Also, the shape of the bag can be varied, e.g. a square configuration. As another feature, the bag walls could be pleated for purposes of expanding the bag volume (in its opened condition). Also, the bag could be attached to the dishwasher rack in various different ways, e.g. fasteners, snaps, or ties. Many other changes could be made while still practicing the basic invention set forth in the appended claims.

The description has been directed to particular embodiments of the invention in accordance with the requirements of the United States patent statutes. It will be apparent to those skilled in the art however, that modifications in the apparatus are possible without departing from the invention. It is intended that the following claims be interpreted to embrace all such modifications.

We claim:

1. A bag for holding small items in a dishwasher, the bag comprising:

a top frame having a resilient front rail member and a resilient rear rail member, each rail member having opposite ends, one of said rail members including a cylindrical structure integrally formed into each end such that each end of said one of said rail members includes a bore, and the other of said rail members including a pin structure integrally formed on each end and having flexible retention prong elements formed on the distal end of each said pin, wherein the pins of the other of said rail members are received into the bores of the one of said rail members and said pins are retained in said cylindrical structures by said prong elements whereby the front rail and rear rail are hingedly connected at the ends of said the rail members such that the rail members are disposed adjacent each other; and a mesh body having a substantially flat, rectangular shape, the mesh body having a first mesh side wall and a second mesh side wall joined together along opposite side edges and a bottom edge, a top edge of the first mesh side wall is connected to the front rail member and a top edge of the second mesh side wall is connected to the rear rail.

2. The bag for holding small items according to claim 1, further wherein each rail member is a relatively straight member.

3. The bag for holding small items according to claim 1 wherein the top frame forms a closure mechanism that is biased closed.

4. A bag for holding small items in a dishwasher, the bag comprising: a top frame having a resilient front rail member and a resilient rear rail member, each rail member having opposite ends, the rail members being pivotably joined at their ends such that the rail members are disposed adjacent each other, and said rear rail member includes at least one resilient hook for engaging a wire of a dishrack such that the bag is secured to the rack; and a mesh body having a substantially flat, rectangular shape, the mesh body having a first mesh side wall and a second mesh side wall joined together along opposite side edges and a bottom edge, a top edge of the first mesh side wall is connected to the front rail member and a top edge of the second mesh side wall is connected to the rear rail.

5. The bag for holding the small items according to claim 4, wherein a first and second notch are formed into the rear rail member on opposite sides of the at least one resilient hook to promote rail flexing at particular locations.

6. A bag for holding small items in a dishwasher, the bag comprising:

a top frame having a resilient front rail member and a resilient rear rail member, each rail member having opposite ends, the rail members being pivotably joined at their ends such that the rail members are disposed adjacent each other, and wherein a notch is formed into at least one of the rail members at a location intermediate said opposite ends to promote rail flexing at said at least one location; and a mesh body having a substantially flat, rectangular shape, the mesh body having a first mesh side wall and a second mesh side wall joined together along opposite side edges and a bottom edge, a top edge of the first mesh side wall is connected to the front rail member and a top edge of the second mesh side wall is connected to the rear rail.

7. A bag for holding small items in a dishwasher, the bag comprising:

a top frame having a resilient front rail member and a resilient rear rail member, each rail member having opposite ends, the rail members being pivotably joined at their ends such that the rail members are disposed adjacent each other; and a mesh body having a substantially flat, rectangular shape, the mesh body having a first mesh side wall and a second mesh side wall joined together along opposite side edges and a bottom edge, a top edge of the first mesh side wall is secured to the front rail member and a top edge of the second mesh side wall is secured to the rear rail, wherein the mesh body is secured to the rail members by a pair of retention strips which are welded to the rail members.

8. The bag for holding the small items according to claim 1, wherein the bottom edge of the mesh body is joined together using tape.

* * * * *